United States Patent [19]

Kober et al.

[11] Patent Number: 4,498,402

[45] Date of Patent: Feb. 12, 1985

[54] METHOD OF REDUCING HIGH TEMPERATURE SLAGGING IN FURNACES AND CONDITIONER FOR USE THEREIN

[76] Inventors: Alfred E. Kober, 81 Claire Dr., Bridgewater, N.J. 08807; Christopher J. Macey, 720 Pearl St., Elizabeth, N.J. 07202

[21] Appl. No.: 503,727

[22] Filed: Jun. 13, 1983

[51] Int. Cl.[3] ..... F23J 11/00

[52] U.S. Cl. ..... 110/345; 110/344; 44/4

[58] Field of Search ..... 110/342, 343, 344, 345; 44/4, 5

[56] References Cited

U.S. PATENT DOCUMENTS 4,245,573 1/1981 Dixit et al. ..... 110/345 X 4,369,719 1/1983 Engstrom et al. ..... 110/343

*Primary Examiner*—Edward G. Favors

*Attorney, Agent, or Firm*—James & Franklin

[57] ABSTRACT

A method of ameliorating high-temperature slagging conditions which result from impaction on the boiler interior surfaces of molten or semi-molten ash particles in flue gas resulting from the combustion of fuel. The method comprises adding a conditioner to the flue gas at or upstream of the high temperature region in the boiler system where slagging tends to occur, and thereafter causing the mixed flue gas and conditioner to flow through the region. Suitable conditioners include strontium carbonate, a mixture of zircon with copper oxychloride and a mixture of alumina with aluminum fluoride, zircon, or zirconyl chloride.

15 Claims, No Drawings

METHOD OF REDUCING HIGH TEMPERATURE SLAGGING IN FURNACES AND CONDITIONER FOR USE THEREIN

BACKGROUND OF THE INVENTION

The present invention relates to minimizing the buildup of slag in high-temperature areas of a furnace system. This is accomplished by adding to the ash-laden flue gas which produces the slag buildup certain substances which reduce the rate of accumulation by altering the chemical and physical characteristics of the ash under prevailing temperatures. The physical properties of the solid ash which does accumulate are such that the deposit is readily removed from the furnace surfaces rather than producing large accretions of buildup on those surfaces.

Boiler slagging occurs when hot, molten or semimolten ash particles strike and adhere to furnace surfaces in the radiant section of the boiler. Fouling occurs in the lower temperature convective sections of the boiler when volatile constituents in the ash such as the alkali oxides condense and collect further ash which then sinters into a hard mass. It is to slagging, and more particularly to the minimization thereof, that the present invention is directed.

Slagging occurs in all furnace systems. Some slap buildup on the inner walls of the furnace is often desirable in order to provide thermal insulation and thus minimize heat loss through the furnace walls, but excessive slag buildup tends to clog the furnace and/or produce excessive temperatures within the furnace.

While slagging problems may occur in connection with all types of fuel, as a practical matter, the problems are particularly acute when coal is the fuel in question, and it is to the control of coal slagging problems that the present invention is directed. The use of coal as a source of energy, particularly for the generation of electric power, can be expected to increase in the future, for economic reasons (the increasing cost of fuel oil) as well as for long term energy policy reasons (making the nation less dependent on imported sources of energy). Coal is not a uniform product—coal supplies from different natural sources have different compositions, different combustion characteristics, and different propensities toward producing slag, and in particular have different ash contents and different ash compositions. Ash content and the composition of the ash greatly affect the tendency to slag production.

The ash produced during combustion is classified according to the way in which it is removed from the boiler. Fly ash is that portion which is entrained in the flue gas and subsequently removed by air pollution control devices such as electrostatic precipitators. Bottom ash, as its name implies, remains in the boiler and is removed through the bottom of the firebox. Boilers are designed to remove this ash as either a molten, flowing slag or a dry, friable ash. Those designed for molten slag removal are known as wet bottom boilers while those designed for solid ash removal are known as dry bottom boilers. It is of critical importance to efficient boiler operation that the ash be in the physical state for which the unit was designed. U.S. Pat. No. 4,057,398, for example, deals primarily with the problems associated with high melting ash in wet bottom boilers. The instant invention is directed towards substantially the opposite problem: to wit, the slagging tendencies of low melting ash in dry bottom boilers. Hence the solution of the slagging problems presented here involves a different approach from that taught in the aforementioned U.S. Pat. No. 4,057,398.

Many coal consumers are being forced to switch from their normal supplies to alternate sources simply because of the increase in demand for coal. In addition, increasingly stringent environmental regulations regarding sulfur dioxide emissions have caused many coal users to switch from their normal high-sulfur coal to low-sulfur supplies. In many cases these alternate coal supplies are completely different from the design coal with regard to ash fusion temperature, ash composition, etc. Substitution of coal with ash characteristics significantly different from those for which a boiler was designed can give rise to problems such as a slagging.

Boiler design is an important factor in determining whether or not deposits will form when a particular fuel is burned. Many factors are considered in designing boilers capable of handling the ash characteristic of a particular coal. The objective of such design considerations is to optimize the combustion process and reduce deposits to a minimum, thus maximizing the efficiency of extraction of energy from the fuel. Maximum heat extraction requires careful control of the relative quantities of heat absorbed through the waterwalls, superheat tubes, reheat tubes, etc. The control of deposits in these areas is, therefore, critical. The correct thermal balance in a deposit-free boiler is achieved by controlling factors such as furnace volume and the relative surface areas of the superheat and reheat sections. Effective heat utilization must be attained without promoting deposit formation, and the final design for a boiler represents the product of effective heat utilization and minimization of deposits.

Slag is a deposit build up by impaction of molten or semimolten ash on a surface where it can solidify. Particles of ash are normally molten when they exit the flame zone of a boiler. If the melting point of the ash or the rate of solidification is too low, the particles will not have sufficient time to solidify before impinging on a boiler surface. When this occurs, the molten or plastic ash adheres to and solidifies on the surface giving rise to a slag deposit. In designing a boiler to burn a particular coal, the characteristics of the ash can be accommodated by adjusting the size of the furnace and thermal profile such that fly ash can solidify before contacting a surface. For any other coal the presence or absence of slag will depend upon the dynamics of the boiler which determine whether the ash is solid or molten by the time it reaches a surface.

Slagging has a major effect on boiler operation. As the plastic ash particles impact on upper furnace walls and superheat tubes, significant accumulations of hard slag can result. Accumulations result in partial blockage of the gas flow, necessitating reductions in boiler load. In some cases, slag may build up to the extent that damage to lower waterwall tubes can result from dislodging heavy accumulations. Another effect of slagging in the boiler is insulation of the waterwall tubes in the radiant section which leads to thermal imbalance within the boiler. As the waterwalls become insulated by slag accumulation, heat transfer efficiency decreases, and temperatures in the superheat section become excessively high. The energy waste and monetary penalty resulting from these conditions are obvious.

Certain mechanical modifications such as increased sootblowing can result in reduction of deposits, but seldom result in complete alleviation of the problem. The most universal method of correcting slagging conditions is simply to reduce load. At reduced load, temperatures throughout the boiler are lower, molten ash solidifies faster, and slagging conditions are minimized. Boiler derations of 10% of total generating capacity due to slagging are not uncommon, and in some cases deration of 25% or more is required to avoid boiler shutdown. While reduction in load is an effective solution to the slagging problem, it is economically undesirable for the obvious reason that equipment is not being used to maximum capacity. Power purchased to meet requirements is more expensive than generated power.

In order to achieve maximum boiler efficiency without damage to steam tubes, superheat and reheat steam temperatures are generally maintained at about 1000° F. When a coating of slag insulates the waterwalls, heat transfer in the furnace area is reduced, which results in higher flue gas temperatures in the superheat/reheat section of the boiler. The correspondingly high superheat and reheat steam temperatures are reduced to the optimum value of about 1000° F. through the use of attemperating sprays. Attemperating spray is water or low-temperature steam which is introduced directly into the superheat or reheat tubes and produces a cooling effect on outlet steam.

In a typical slagging boiler little or no attemperating spray is required when the unit starts up, since waterwall tubes are clean and heat absorption in the furnace area is efficient. As waterwalls begin to slag, excessively high steam temperatures in the superheat and/or reheat tubes necessitate the use of attemperating spray. As slagging of the waterwalls continues to increase, attemperating sprays automatically increase. Finally, when the maximum sprays are reached and steam temperatures are still too high, thermal balance in the boiler can only be restored by reducing load and shedding slag. Slag separates from the tube surfaces upon reducing load and cooling the boiler because of the difference in contraction rates of metal and slag.

The length of a cycle from start-up with clean waterwalls until deration becomes necessary to shed slag varies with the severity of the problem, but can be as short as several hours. It is usually difficult, if not impossible, to observe the buildup of waterwall slag while the boiler is in operation. Even where observation is possible, this technique does not provide a quantitative measure of slag buildup. Since attemperating spray usage is proportional to the degree of waterwall slagging, however, it serves as a useful measure of the severity of the slagging condition. Attemperating spray usage is normally recorded continuously and serves as a quantitative record of the development of a slagging condition from start-up to final deration.

One commonly used method of assessing slagging potential of coal ash is the ASTM fusion test. In this test small cones of ash particles are heated and the temperatures of various degrees of deformation noted. However, recent investigations brought the realization that the observable softening temperature of the ash was in many instances not the controlling characteristic thereof insofar as slag production is concerned. The ash particles, it was discovered, after being made molten, would upon recooling remain molten to temperatures well below their normal melting temperature, and they would then strike the boiler surfaces while still molten and harden into amorphous glassy solids which would be very tough and removal-resistant. The fact that they supercooled before solidifying meant that deposits would remain molten within the furnace for longer periods of time, thus permitting additional particles to be caught by the molten deposit mass, thereby increasing the speed and amount of buildup, while the dense state of the solidified mass made it exceedingly difficult to remove.

U.S. Pat. No. 4,372,227, entitled "Method of Reducing High Temperature Slagging In Furnaces," notes that there are certain substances which, when combined with the molten ash, will have the characteristic of minimizing the super-cooling tendency of the untreated particles and thus accelerate the particle solidification into a crystalline material rather than an amorphous, glassy mass, and theorizes that those substances served as nucleating agents during the cooling of the ash particle, causing that particle to solidify at a temperature quite close to its normal melting temperature and fostering its solidification into a crystalline form. More specifically, the aforementioned U.S. Pat. No. 4,372,227 teaches that the addition of particles of alumina, silicon carbide or aluminum nitride are extremely effective in that regard.

The object of the present invention is to provide a method of ameliorating high-temperature slagging conditions which result from impaction on the boiler interior surfaces of molten or semi-molten ash particles in flue gas resulting from the combustion of the fuel.

Another object is to provide such a method which is economical because it utilizes a synergistic mixture as the conditioner added to the flue gas.

A further object is to provide such a method which utilizes as the conditioner compounds which would not appear useful for that purpose according to ash fusibility tests.

SUMMARY OF THE INVENTION

It has now been found that the above and related objects of the present invention are obtained in a method of ameliorating high-temperature slagging conditions which result from impaction on the boiler interior surfaces of molten or semi-molten ash particles in flue gas resulting from the combustion of fuel. The method comprises adding conditioner to the flue gas at or upstream of the high-temperature region in the boiler system where slagging tends to occur, and thereafter causing the mixed flue gas and conditioner to flow through the region. The conditioner is selected from the group consisting of strontium carbonate, a mixture of zircon with copper oxychloride, a mixture of alumina with aluminum fluoride, zircon, or zirconyl chloride, and a mixture of hydrated aluminum silicate, unexpanded perlite ore, unexpanded vermiculite ore or strontium carbonate with copper oxychloride, zircon, or zirconyl chloride.

In a preferred embodiment the conditioner is a compound selected from the group consisting of strontium carbonate, mixtures thereof or a synergistic mixture selected from the group consisting of a mixture of zircon with copper oxychloride and a mixture of alumina with aluminum fluoride, zircon, or zirconyl chloride.

Preferably the conditioner mixtures comprise from 50 to 98% by weight of the first ingredient and from 50 to 2% by weight of the second ingredient.

The conditioner is added to the flue gas either by being introduced into the combustion region when the fuel is burned or by being injected into the flue gas downstream of the combustion region. The conditioner is preferably initially added to the flue gas in the form of finely divided particles of either the conditioner or a precursor thereof under flue gas conditions. The conditioner is provided at a rate of about 0.1–10.0% by weight of the ash content of the fuel, preferably 0.2–5.0%, and optimally 0.2–2.0%.

DETAILED DESCRIPTION OF THE PREFERRED EMBODIMENTS

The present invention provides a method of ameliorating high temperature slagging conditions which result from impaction on the boiler interior surfaces of molten or semi-molten ash particles in flue gas resulting from the combustion of coal. The method comprises adding a conditioner to the flue gas at or upstream of the high temperature region in the boiler system where slagging tends to occur, and thereafter causing the mixed flue gas and conditioner to flow through the region. The conditioner is typically added to the flue gas either by being introduced into the combustion region when the fuel is burned or by being injected into the flue gas downstream of the combustion region.

The conditioner is selected from the group consisting of strontium carbonate, a mixture of zircon (as the first ingredient) with copper oxychloride (as the second ingredient), a mixture of alumina (as the first ingredient) with aluminum fluoride, zircon, or zirconyl chloride (as the second ingredient), and a mixture of hydrated aluminum silicate, unexpanded perlite ore, unexpanded vermiculite ore or strontium carbonate (as the first ingredient) with copper oxychloride, zircon, or zirconyl chloride (as the second ingredient).

While the conditioner may simply be strontium carbonate, preferably the conditioner is a synergistic combination selected from the group consisting of a mixture of zircon with copper oxychloride and a mixture of hydrated alumina with aluminum fluoride, zircon, or zirconyl chloride. Mixtures of hydrated aluminum silicate, unexpanded perlite ore, unexpanded vermiculite ore, or strontium carbonate (as the first ingredient) with copper oxychloride, zircon, or zirconyl chloride (as the second ingredient) are also believed to be synergistic in nature. The mixtures comprise from 50 to 98% by weight of the first ingredient and from 50 to 2% by weight of the second ingredient. As the second ingredients tend to be more expensive than the first ingredients, generally substantially lesser quantities of the second ingredient will be present than the first ingredient, the preferred ratios being easily determinable through a cost/benefit analysis for various ratios.

In considering the amount of conditioner to be utilized, measurement in pounds per ton of coal burned is not a particularly meaningful statistic because coals vary so greatly in ash content and in the chemical composition of the ash. A more meaningful statistic is the amount of additive expressed in terms of percent by weight of the ash content of the coal.

In accordance with the present invention the conditioner can be provided at a rate of about 0.1–10.0% by weight of the ash content of the fuel, with a preferred range of 0.2–5.0% by weight, and with a highly preferred range of 0.2–2.0% by weight. While conditioner rates as high as 10% by weight may be used, generally such high rates would not be economical and would only be found in laboratory applications.

The conditioner is preferably added to the furnace in the form of finely divided particles to facilitate their mixing with the flue gas, but it could be introduced in a liquid form; e.g., as a slurry. In some instances the conditioner may be initially added to the flue gas in the form of a precursor which, under flue gas conditions, produces the desired conditioner.

While the principles of operation of the conditioners of the present invention are not known with any certainty, it is believed that in some of the synergistic mixtures one ingredient (e.g., zircon) is serving primarily as a nucleating agent during the cooling of the ash particle, causing that particle to solidify at a temperature quite close to its normal melting temperature and fostering its solidification into crystalline form, while the other ingredient is serving primarily either as a physical disruptor of slag deposits (e.g., hydrated aluminum silicate, unexpanded vermiculite or perlite ore, and strontium carbonate), exhibiting a varying density or gas evolution which physically breaks up the slag and facilitates its removal or as a chemical modifier of the ash (e.g., alumina), increasing its softening temperature. The hydrated form of alumina is preferred over the calcined form because of its activity as a physical disruptor as well as a nucleating agent and chemical modifier. No mechanism has yet been postulated for the action of the zirconyl chloride, aluminum fluoride, or copper oxychloride ingredient of the synergistic mixtures. Believed to be acting primarily as physical disruptors are the various compounds of the present invention used by themselves: the unexpanded perlite or vermiculite ore, and strontium carbonate. Mixtures of these are also useful in the present invention.

Use of the conditioners here disclosed will not only greatly minimize slag buildup in initially clean boilers, and render readily removable such slag as does form, but is also effective, when injected into furnaces where slag has already built up, in preventing further slag buildup and in facilitating removal of the pre-existing slag after the conditioner has been used for a period of time.

EXAMPLE

A pilot-scale slagging device was developed and utilized to evaluate the slag-modifying characteristics of various materials under simulated boiler conditions. This device consisted of a 300,000 BTU/hr burner firing heating oil. The flame and hot flue gases from the burner were directed down a refractory-lined pipe with an internal diameter of ten inches and through a water tube heat exchanger. An induced draft fan downstream of the heat exchanger provided negative pressure throughout the test system which allowed coal fly ash to be aspirated directly into the flame zone. Several feet downstream from the fly ash injection point an air-cooled deposit probe was inserted into the hot gas stream perpendicular to the direction of gas flow.

In a typical experiment the oil burner was ignited and combustion conditions were adjusted to reproducible levels of excess air and temperature as determined by an oxygen monitor and thermocouples in the system. When the combustion conditions had stabilized, coal fly ash was metered into the flame at a rate of 2 lbs/hr using a screw feeder. Upon passage through the flame, fly ash particles melted, providing a stream of molten particles in hot flue gas which simulated the environment in a full-scale coal-fired furnace. A portion of the molten particles impinged on the air-cooled deposit probe downstream of the flame, solidified, and accumulated as a slag deposit. At the end of a timed experiment, fly ash addition was stopped, the deposit probe was removed, and the slag buildup accurately weighed. Deposition rates were calculated as weight of deposit per unit area of probe surface per weight of fly ash fed.

Various potential slag modifiers or conditioners were evaluated by comparing the deposition rate of untreated fly ash to the deposition rate obtained by introducing a mixture of the fly ash and slag modifier into the slag test unit. The results of screening various coal ash slag modifiers are summarized in Table I. For the substances tested, the results are expressed as precent change in deposition rate compared to untreated fly ash and were calculated using the formula:

$$\text{Change in deposition rate} = \left( \frac{\text{Treated dep. rate} - \text{Baseline dep. rate}}{\text{Baseline deposition rate}} \right) \times 100$$

A negative change in deposition rate, therefore, signifies a desirable reduction in slag formation by the treated ash compared to untreated ash. The change in ASTM softening temperature (Ash Fusibility Test, ASTM D1857-63) is also given for some of the additives for comparison purposes, since this test is generally accepted in the industry as a measure of ash behavior. In this case, an additive which produced a positive change in softening temperature (i.e., treated ST-untreated ST) would conventionally be regarded as having a desirable effect on slagging characteristics of the ash.

TABLE I

The Effect of Additives on Slagging Characteristics[1]

| Run | Additive[2] Component A | Component B | Observed Change In Deposition Rate | ST[3] |
|---|---|---|---|---|
| 1 | Hydrated alumina | — | −10.8% (2 tests) | +75° F. |
| 2 | Aluminum fluoride | — | 9.5% (2 tests) | — |
| 3 | Calcium cyanamide | — | 1.0% (2 tests) | −270° F. |
| 4 | Copper oxychloride | — | −14.5% (2 tests) | −42° F. |
| 5 | Manganese dioxide | — | 20.2% (3 tests) | −135° F. |
| 6 | Magnesium oxide | — | −32.1% (3 tests) | — |
| 7 | Unexpanded Perlite Ore | — | −25.6% (3 tests) | −98° F. |
| 8 | Potassium silicofluoride | — | 7.8% (2 tests) | — |
| 9 | Pyrophyllite | — | 29.6% (2 tests) | — |
| 10 | Strontium carbonate | — | −33.1% (4 tests) | −142° F. |
| 11 | Titanium dioxide | — | 16.6% (4 tests) | −32° F. |
| 12 | Unexpanded vermiculite ore | — | −12.8% (4 tests) | −175° F. |
| 13 | Zircon | — | −6.3% (4 tests) | −5° F. |
| 14 | Zirconium dioxide | — | 6.6% (2 tests) | — |
| 15 | Hydrated alumina/ | aluminum fluoride | −37.7% (2 tests) | — |
| 16 | Hydrated alumina/ | zircon | −52.3% (2 tests) | — |
| 17 | Hydrated alumina/ | zirconyl chloride | −14.3% (1 test) | — |
| 18 | Magnesium oxide/ | copper oxychloride | 7.8% (2 tests) | −50° F. |
| 19 | Zircon/ | copper oxychloride | −34.0% (2 tests) | — |

[1]All tests conducted on Rosebud subbituminous fly ash.
[2]All additives/addditive combinations used at 10% by weight in ash except for Run 4, which was 1%. Additive combinations 15–19 contained 90% by weight of Component A and 10% by weight of component B except for number 15, which was a 1:1 mixture.
[3]ASTM D1857-63 Ash Fusibility Test; ST = softening temperature Examination of Table I reveals that there was little correlation between the ASTM softening temperature change and the deposition tendencies actually observed. Only for Run 1, hydrated alumina, did the ASTM test correctly predict an improvement in slag deposition rate. For the remaining nine additives for which fusion data were obtained, the ASTM test predicted an increase in slag deposition. For five of these additives (Runs 4, 7, 10, 12, and 13) significant reductions in slag deposition rate were actually observed using the slag test unit at simulated boiler conditions. (For three of these additives [Runs 5, 11, and 18 ] the ASTM test successfully predicted an undesirable increase in deposition rate with additive treatment.)

Although the reason for the observed lack of correlation of the ASTM test with decreased slagging tendency in many cases is unknown, it may be that certain additives act by physically disrupting the deposit. For example, vermiculite (Run 12) expands dramatically upon heating, and strontium carbonate (Run 10) evolves carbon dioxide. The ASTM test measures the chemical effect on ash, which apparently is undesirable for these two additives, but does not predict the dominant physical effect. Whatever the mechanism, the decreased deposition rate results shown in Table I are entirely unexpected on the basis of the commonly accepted ASTM fusibility test for the additives of the present invention (Runs 7, 10, 12, 15–17, 19).

Examination of Table I also reveals that certain additive combinations produce unexpected synergistic effects on slag deposition rates. The use of alumina (Run 1) and zircon (Run 13) individually to alleviate slagging has been described previously. The use of a combination of these two substances at the same total treatment level gave a synergistic improvement in slag deposition rate (see Run 16). Other combinations of additives also produced dramatic synergistic improvements. For example, the combination zircon/copper oxychloride (compare Runs 4, 13, and 19) produced synergistic effects more than double those of the individual components. While aluminum fluoride was actually detrimental to deposition rate when used separately, the combination hydrated alumina/aluminum fluoride (compare Runs 1, 2, and 15) showed that the aluminum fluoride enhanced the effect of hydrated alumina.

Run 18 is included to demonstrate that synergy is not a predictable result. In this case (compare Runs 4, 6, and 18), two effective slag modifiers combine to produce a mixture which actually is detrimental to slag deposition rate.

To summarize, the present invention provides a method of ameliorating high temperature slagging conditions which can utilize compounds not predictable as useful through ash fusion tests and which is economical because it can utilize synergistic mixtures.

Now that the preferred embodiments of the present invention have been described in detail, various modifications and improvements therein will become readily apparent. Accordingly, the spirit and scope of the present invention is to be limited only by the appended claims and not by the foregoing disclosure.

We claim:

1. A method of ameliorating high-temperature slagging conditions which result from impaction on the boiler interior surfaces of molten or semi-molten ash particles in flue gas resulting from the combustion of coal, which method comprises (a) at or upstream of the high-temperature region in said boiler system where slagging tends to occur, adding to said flue gas a conditioner selected from the group consisting of strontium carbonate, a mixture of zircon with copper oxychloride, a mixture of alumina with aluminum fluoride, zircon or zirconyl chloride, and a mixture of hydrated aluminum silicate, unexpanded perlite ore, unexpanded vermiculite ore or strontium carbonate with copper oxychloride, zircon, or zirconyl chloride; and (b) thereafter causing said mixed flue gas and conditioner to flow through said region.

2. The method of claim 1 wherein said conditioner is strontium carbonate.

3. The method of claim 1 wherein said conditioner is a synergistic mixture selected from the group consisting of a mixture of zircon with copper oxychloride and a mixture of alumina with aluminum fluoride, zircon, or zirconyl chloride.

4. The method of claim 3 wherein said conditioner mixtures comprise from 50 to 98% by weight of the first ingredient and from 50 to 2% by weight of the second ingredient.

5. The method of claim 3 wherein said alumina is hydrated alumina.

6. The method of claim 1, in which said conditioner is initially added to said flue gas in the form of particles of said conditioner of or precursors thereof under flue gas conditions.

7. The method of claim 1 in which said conditioner is added to said flue gas by being introduced into the combustion region when said coal is burned.

8. The method of claim 1, in which said conditioner is injected into said flue gas downstream of the combustion region.

9. The method of claim 1, in which said conditioner is provided at a rate of about 0.1–10.0% by weight of the ash content of said coal.

10. The method of claim 9, in which said conditioner is provided at a rate of about 0.2–5.0% by weight of the ash content of said coal.

11. The method of claim 10, in which said conditioner is provided at a rate of about 0.2–2.0% by weight of the ash content of said coal.

12. A fly ash conditioner for use in a method of ameliorating high-temperature slagging conditions which result from impaction on the boiler interior surfaces of molten or semi-molten ash particles in flue gas resulting from the combustion of coal, which method comprises, at or upstream of the high-temperature region in the boiler system where slagging tends to occur, adding to the flue gas a conditioner and thereafter causing the mixed flue gas and conditioner to flow through the said region, said conditioner being selected from the group consisting of strontium carbonate, a mixture of zircon with copper oxychloride, a mixture of alumina with aluminum fluoride, zircon or zirconyl chloride, and a mixture of hydrated aluminum silicate, unexpanded perlite ore, unexpanded vermiculite ore or strontium carbonate with copper oxychloride, zircon, or zirconyl chloride.

13. The conditioner of claim 12 wherein said conditioner is strontium carbonate.

14. The conditioner of claim 1 wherein said conditioner is a synergistic mixture selected from the group consisting of a mixture of zircon with copper oxychloride and a mixture of alumina with aluminum fluoride, zircon, or zirconyl chloride.

15. The method of claim 12 wherein said alumina is hydrated alumina.

* * * * *

UNITED STATES PATENT AND TRADEMARK OFFICE

CERTIFICATE OF CORRECTION

PATENT NO. : 4,498,402

DATED : February 12, 1985

INVENTOR(S) : Alfred E. Kober, et al.

It is certified that error appears in the above-identified patent and that said Letters Patent is hereby corrected as shown below:

Column 10, line 37, Claim 14, "Claim 1" should read --Claim 12--.

Signed and Sealed this

*Twentieth* Day of *August 1985*

[SEAL]

*Attest:*

DONALD J. QUIGG

*Attesting Officer*

*Acting Commissioner of Patents and Trademarks*